United States Patent [19]

Honda et al.

[11] 4,446,228

[45] May 1, 1984

[54] SILVER HALIDE PHOTOGRAPHIC MATERIAL

[75] Inventors: Chika Honda, Hino; Masatoshi Iwata, Akishima; Takeo Koitabashi, Sagamihara, all of Japan

[73] Assignee: Konishiroku Photo Industry Co., Ltd., Japan

[21] Appl. No.: 372,128

[22] Filed: Apr. 27, 1982

[30] Foreign Application Priority Data

Apr. 28, 1981 [JP] Japan ..... 56-63281

[51] Int. Cl.[3] ..... G03C 1/02

[52] U.S. Cl. ..... 430/567; 430/496; 430/502; 430/966

[58] Field of Search ..... 430/567, 569, 365, 502, 430/496, 966

[56] References Cited

U.S. PATENT DOCUMENTS

| | | | |
|---|---|---|---|
| 3,923,515 | 12/1975 | Van Stappen | 430/567 |
| 3,989,527 | 11/1976 | Locker | 430/567 |
| 4,023,972 | 5/1977 | Vanassche | 430/569 |
| 4,067,739 | 1/1978 | Lewis | 430/567 |
| 4,177,071 | 12/1979 | DeBrabandere | 430/569 |
| 4,301,242 | 11/1981 | Pätzold et al. | 430/569 |

*Primary Examiner*—Mary F. Downey

*Attorney, Agent, or Firm*—Finnegan, Henderson, Farabow, Garrett & Dunner

[57] ABSTRACT

A silver halide photographic material comprising a base having formed thereon a silver halide emulsion layer substantially made of two or more monodisperse emulsions having different average grain sizes in the range of from 0.2 to 3.0 μm is disclosed. The grain size distribution curve of the silver halide grains in said emulsion layer has two or more peaks, and the distance between the highest peak and the second highest peak is at least 0.3 μm.

4 Claims, 2 Drawing Figures

SILVER HALIDE PHOTOGRAPHIC MATERIAL

FIELD OF THE INVENTION

The present invention relates to a X-ray silver halide photographic material that uses less silver and which yet has high sensitivity. More particularly, the invention relates to a high-sensitivity X-ray silver halide photographic material having improved granularity.

BACKGROUND OF THE INVENTION

Today, there is a concern over the depleting resources of silver which is the primary component of silver halide photographic materials. At the same time, the price of silver is very unstable mainly due to the recent soaring of the oil price. It is therefore necessary to minimize the silver content of X-ray silver halide photographic materials so that they can be supplied to consumers at a stable price.

The development of a high-sensitivity X-ray silver halide photographic material having improved granularity is one of the most important objectives in the art. In high-sensitivity radiography for medical applications where the use of silver should be reduced, it is required to minimize the time of exposure to X-rays for information recording, record the information accurately and to facilitate the viewing of the recorded information for the purpose of reducing the dose of exposure to X-rays as well as for minimizing the chance of group exposure. The requirement of reduced silver content also applies to general picture-taking photographic materials, and the development of a high-sensitivity X-ray silver halide photographic material having improved granularity is desired.

SUMMARY OF THE INVENTION

Therefore, one object of the present invention is to provide a high-sensitivity silver halide photographic material with reduced silver content.

Another object of the invention is to provide a high-sensitivity X-ray silver halide photographic material having improved granularity.

These and other objects which are described hereinafter are achieved by a X-ray silver halide photographic material comprising a support having formed thereon a silver halide emulsion layer containing two or more kinds of monodispersed silver halide emulsions having different average grain sizes in the range of from 0.2 to 3.0 μm, wherein the grain size distribution curve of the silver halide grains in said emulsion layer has two or more peaks, the distance between the highest peak and the second highest peak being at least 0.3 μm. According to one preferred embodiment of the invention, the silver halide emulsion layer is made of not more than five monodispersed emulsions, and the number of the silver halide grains having a smaller grain size than the median of the average grain size of all the grains is larger than that of the silver halide grains having a grain size greater than the median.

DETAILED DESCRIPTION OF THE INVENTION

Figure 1:
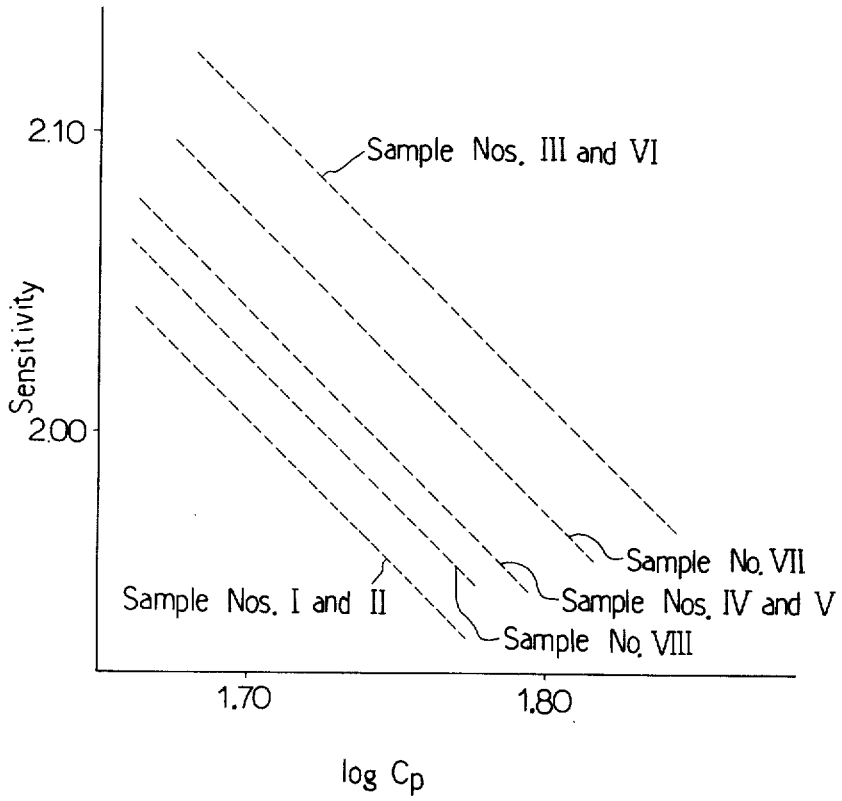
FIG. 1 is a graph showing on the logarithmic scale the relation between the relative covering power and sensitivity for Samples Nos. I to VIII prepared in Examples 1 and 2.
Figure 2:
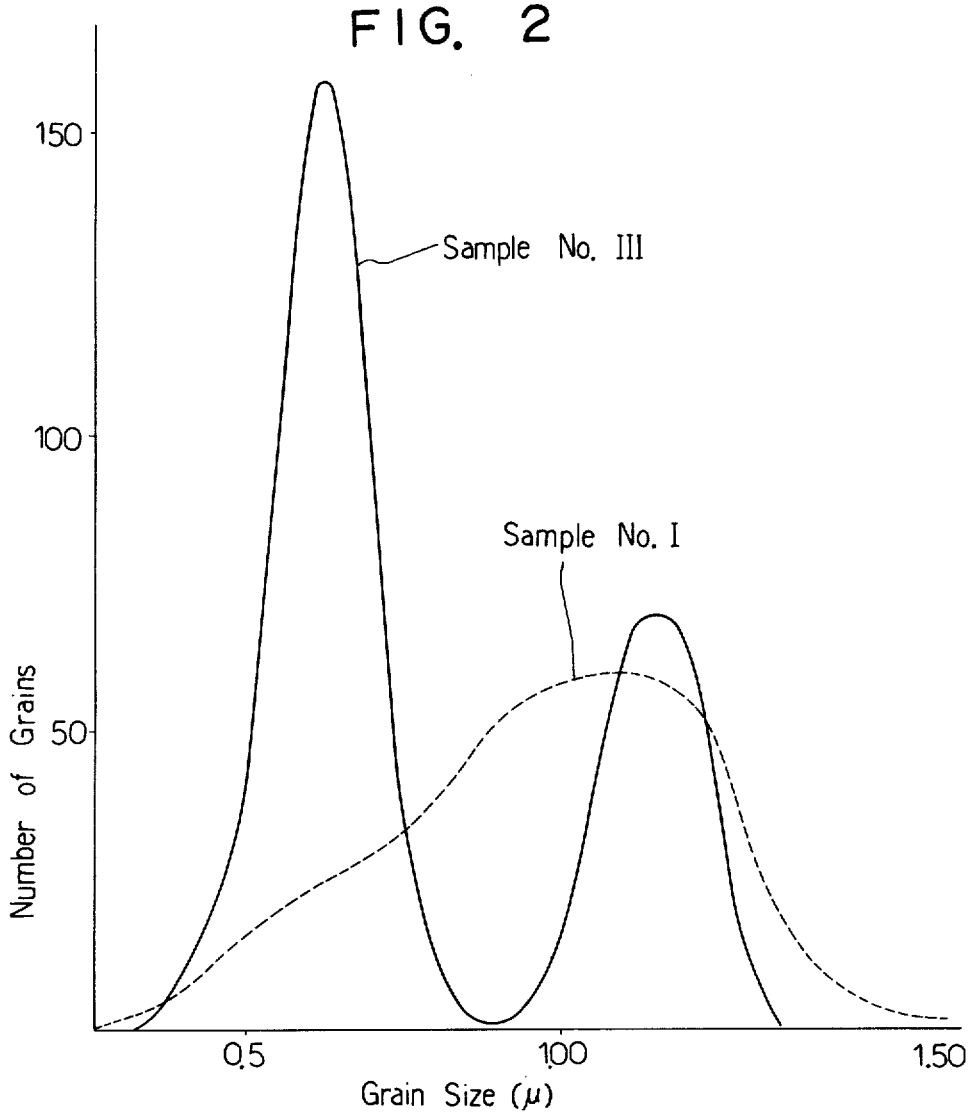
FIG. 2 is a graph showing the grain size distribution for Samples Nos. I and III prepared in Example 1.

As is well known, the sensitivity of a X-ray silver halide photographic material is increased by using larger silver halide grains. But at the same time, the covering power of the material is decreased as reported by G. C. Farnell in The Journal of Photographic Science, 17, 116 (1969). The covering power is defined as the magnitude of the degree of blackening reached for the unit amount of silver produced when the X-ray silver halide photographic material is exposed and developed. If the covering power of the silver halide grain, is great less silver halide need be used to obtain the maximum optical density for a given photographic material, and at the same time, the granularity of the silver halide grain is improved since a smaller grain serves the purpose. But on the other hand, the sensitivity of the photographic material is decreased (the logarithm of the covering power is in inverse proportion to the logarithm of the sensitivity). The present invention overcomes this dilemma in the established theory of photography.

There are many techniques for sensitization, i.e. increasing the sensitivity of a X-ray silver halide photographic material for a given grain size. Among these methods are: (1) addition of a development accelerator such as a thioether in the emulsion; (2) supersensitizing a spectral-sensitized silver halide emulsion with a suitable combination of dyes; and (3) using an improved chemical sensitizer. But these methods are not always applicable to high-sensitivity X-ray silver halide photographic materials. The silver halide emulsion used in the high-sensitivity X-ray silver halide photographic material is subjected to as much chemical sensitization as possible, so if it is sensitized by any one of the methods described above, it has a tendency to undergo fog during storage. An X-ray silver halide photographic material for radiography that has the minimum gelatin content to achieve rapid processing produces only an image of low quality if it is sensitized by these methods. In particular, the supersensitization has desensitizing effects such as fading of a latent image, and hence is detrimental to the stability of the exposed photographic material.

By making efficient use of the necessary minimum amount of a silver halide emulsion, the present inventors have successfully prepared a high-sensitivity X-ray silver halide photographic material having improved granularity. Generally, a polydispersed silver halide emulsion has a near-normal distribution of silver halide grain size. The sensitivity of an X-ray silver halide photographic material incorporating such emulsion depends on the size and number of the larger silver halide grains. In the area having low sensitivity but high density, the sensitivity is dependent on the size and number of the smaller silver halide grains. In the prior art, the distribution of the larger and smaller silver halide grains is left to chance, and the resulting X-ray silver halide photographic material is not always designed to have an effective distribution.

According to the present invention, by controlling the distribution of the size of the X-ray silver halide grains, a high-sensitivity silver halide photographic material having improved covering power and granularity can be provided. These advantages of the invention are entirely unexpected from the above described prior art techniques.

In the present invention, monodispersed silver halide emulsions having at least two different average grain sizes in the range of from 0.2 to 3.0 μm are used. The term "average grain size" as used herein means the average diameter of spherical silver halide grains, and the average diameter of circles whose area is equivalent to that of the projected image of cubic grains or grains having a geometry other than a sphere. When the size of individual grains is (ri) and their number is (ni), the average grain size ($\bar{r}$) is defined by the following formula:

$$\bar{r} = \frac{\Sigma ni \cdot ri}{\Sigma ni}$$

In the present invention, if the average grain size of the monodispersed silver halide emulsions is greater than 3.0 μm, the granularity of the silver halide grains is impaired greatly, and the desired sensitizing effect is not always obtained, and hence, the intended advantages of the present invention are not achieved. If the average grain size is less than 0.2 μm, the sensitivity of the X-ray silver halide photographic material is decreased greatly, and the intended sensitivity or characteristic curve is not obtained. The silver halide grains used in the present invention preferabley have an average grain size between 0.5 and 1.4 μm.

The monodispersed emulsion as used in the present invention is such that the quotient of the standard deviation (S) as divided by the average grain size ($\bar{r}$) is 0.16 or less:

$$\frac{S}{\bar{r}} \leqq 0.16 \left( \text{wherein } S = \frac{\sqrt{\Sigma(\bar{r} - ri)^2 \cdot ni^2}}{\Sigma ni} \right).$$

If $S/\bar{r}$ is more than 0.16, it is difficult to reduce the silver content. The advantages of the present invention are remarkable if $S/\bar{r}$ is 0.12 or less.

According to one preferred embodiment of the present invention, the silver halide grains used are substantially made of silver bromide, and they may contain not more than 10 mol% of silver chloride and not more than 12 mol% of silver iodide. By the expression "substantially made of silver bromide" is meant that the grains contain silver bromide as a major component, that they may contain up to 12 mol% of silver iodide which is preferred for achieving higher sensitivity, and that they may also contain up to 10 mol% of silver chloride for increasing the susceptibility to chemical sensitization and developability which are closely related to the overall sensitivity. Therefore, the silver halide that can be used in present invention is AgBr, AgBrI, AgBrCl or AgBrClI. If the proportion of silver iodide exceeds 12 mol%, the fixing time is prolonged and rapid processing may not be realized. If the proportion of silver chloride exceeds 10 mol%, the sensitivity decrease is rather great and such silver halide is less preferable.

In the present invention if monodispersed emulsions having at least two different average grain sizes are used, then these emulsions may have the same or different compositions of silver halide. A mixture of the monodispersed emulsions having at least two different average grain sizes has a grain size distribution curve having two or more peaks, and it is necessary that the highest peak be spaced from the second highest peak by at least 0.3 μm in terms of the grain size. Said space is preferably at least 0.5 μm. The number of the monodispersed emulsions having different average grain sizes is desirably not more than five. If six or more such emulsions are used, the grain size distribution curves of the respective emulsions overlap each other too much to provide a suitably controlled grain size distribution. The use of not more than three monodispersed emulsions having different average grain sizes is particularly desired.

In the present invention that employs monodispersed emulsions having at least two different average grain sizes, the number of the grains whose size is smaller than the median of the average size of the grains contained in the emulsions is desirably larger than that of the grains whose size is greater than that median. For example, the number of the silver halide grains contained in a monodispersed emulsion having an average grain size smaller than the median of the average size of all the grains is desirably larger than that of the grains contained in a monodispersed emulsion having an average grain size greater than said median. If the number of the former grains is smaller than that of the latter grains, it is difficult to reduce the silver content.

In the present invention, it is preferred that the individual monodispersed emulsions be sensitized chemically by the method most suitable for each emulsion. Any known technique of chemical sensitization can be used, such as sulfur sensitization, gold sensitization, selenium sensitization and reduction sensitization, and two or more of these techniques can be combined. The reaction speed differs according to the size of silver halide grains, so if the same technique is used for all monodispersed emulsions or if they are sensitized as a mixture rather than individually, the respective emulsions cannot always be provided with the maximum sensitivity.

Sulfur sensitization can be performed with, for example, sodium thiosulfate, thiourea or allyl thiourea. Gold sensitization can be performed with, say, sodium chloroaurate or auric potassium thiocyanate. Gold-sulfur sensitization can be performed with at least one gold sensitizer and at least one sulfur sensitizer. These two sensitizers can be used in combination with ammonium thiocyanate or the like. The silver halide emulsions used in the present invention can also be subjected to selenium sensitization by the method described in U.S. Pat. No. 1,574,944 which uses selenourea or N,N'-dimethylselenourea, or any other known method described in, say, U.S. Pat. No. 3,591,385, Japanese Patent Publications Nos. 13849/68 and 15748/69. Reduction sensitization can also be achieved by any known method, for instance, ripening in a low-pAg atmosphere, or using a suitable reducing agent, or by exposure to electromagnetic waves such as light and gamma-rays.

The monodispersed emulsions having at least two different average grain sizes may be applied to a base in either discrete layers or in a single layer made of their mixture. Every known base can be used in the X-ray silver halide photographic material of the present invention, and examples are a polyester such as polyethylene terephthalate film, a polyamide film, a polycarbonate film, a polystyrene film, or baryta paper, or paper having a synthetic polymer coating. One or both sides of the base can be coated with the emulsions of the present invention. When both sides are coated, the arrangement of emulsions layers may be symmetrical or asymmetrical with respect to the base.

According to U.S. Pat. No. 3,923,515, a double side coated silver halide X-ray photographic material that has reduced "print-through" or "cross-over" can be produced by first forming a low-sensitivity emulsion on a base and then overcoating it with a high-sensitivity emulsion. According to the present invention, there is no significant difference between the dual layer arrangement and single layer arrangement in the effect of reducing print-through or cross-over in the silver halide photographic material. The photographic materials prepared in the Examples of said U.S. Patent have a silver deposit of more than 6 g/m$^2$, and the specification contains no passage that suggests that the emulsions employed are of a monodispersed system. Therefore, the present invention achieves its objects by a method that entirely differs from the method described in said U.S. Patent.

U.S. Pat. Nos. 3,050,391 and 3,140,179 disclose a technique of forming two emulsion layers having different compositions of silver halide, but in that technique, the composition of the emulsion in the overcoat differs greatly from that of the emulsion in the layer underneath. Therefore, said technique differs entirely from the method of the present invention with respect to the composition of the emulsions used. In short, the high-sensitivity X-ray silver halide photographic material using less silver and yet having improved granularity is entirely unobvious from the prior art.

The concept of the present invention is applicable to all types of silver halide photographic material, but it is particularly adapted to a high-sensitivity, black-and-white or color negative phtotographic material. If it is applied to medical X-ray radiography, it is preferred that a fluorescent sensitizing screen primarily made of a fluorescent substance emitting near-ultraviolet or visible light rays upon exposure to a transmitting radiation be contacted to both sides of an X-ray silver halide photographic material having a coating of the emulsions of the present invention on both sides. The transmitting radiation here used means electromagnetic waves of high energy, i.e. X-rays and gamma-rays. Illustrative fluorescent sensitizing screen are a sensitizing screen containing calcium tungstate ($CaWO_4$) as the primary fluorescent component, and a sensitizing screen containing a terbium-activated rare earth compound as the principal fluorescent component.

The X-ray silver halide photographic material according to the present invention achieves a significant advantage when it is used in high-temperature rapid processing by an automatic developing machine wherein the photographic material is transported through rollers, as described in Japanese Patent Publication No. 47045/76. In high-temperature rapid processing, the granularity of the silver halide grains is generally impaired, but if the X-ray silver halide photographic material of the present invention is used, the granularity is least impaired and the sensitivity of the material is effectively increased.

In the present invention, gelatin is the most preferred as a hydrophilic colloid in which the silver halide grains are dispersed. To further improve the physical properties of the binder, the following materials may be used: gelatin derivatives; other natural hydrophilic colloids such as albumin, casein, agar and gum arabic; alginic acid and its derivatives such as its salt, amide or ester; starch and its derivatives; cellulose derivatives such as cellulose ether, partially hydrolyzed acetyl cellulose and carboxymethyl cellulose; and synthetic hydrophilic resins such as polyvinyl alcohol, polyvinyl pyrrolidone, acrylic acid and methacrylic acid or their derivatives such as ester or amide; nitrile homopolymer and copolymer; and vinyl polymers such as polyvinyl ether and polyvinyl ester.

For rapid processing in an automatic developing machine, the X-ray silver halide photographic material preferably contains the least amount of gelatin so that it can be dried quickly. On the other hand, if the gelatin content is reduced too much, its function as a protective colloid is reduced and the chance of pressure marks to develop during the roller transport is increased. Therefore, the weight ratio of the gelatin to silver halide in terms of silver is preferably in the range of from 0.4 to 0.8.

The silver halide grains used in the X-ray silver halide photographic material of the present invention may be either those having irregular crystal habit including such as a twinned, a spherical or platy form, or those having a regular crystal habit such as a cube, octahedron or tetradecahedron and grains with a regular crystal habit are preferred. According to a more preferable embodiment of the invention, silver halide grains in the largest peak consist essentially of regular octahedron or tetradecahedron crystals, and most preferably they are regular octahedron crystals. Regular and irregular formed grains may be mixed.

The silver halide grains used in the X-ray silver halide photographic material of the present invention may be prepared by the acid method, neutral method or ammonia method. Alternatively, seed grains are first formed by the acid method, then they are grown to a predetermined size by the ammonia method that achieves high growth rate. The silver halide grains are desirably grown in a reactor at controlled values of pH and pAg by sequentially or simultaneously charging silver ions and halide ions in the amounts that correspond to the growth rate of the silver halide grains, as described in Japanese Patent Application (OPI) No. 48521/79 (the symbol OPI as used herein means an unexamined published Japanese patent application). As the silver halide grains according to the present invention grow, ionic noble metals such as Ir, Rh, Pt and Au may be incorporated in the interior of the grains. Alternatively, the interior of the grains may be imparted a reduction sensitizable nucleus by putting them in a low pAg atmosphere or by using a suitable reducing agent. After the growth of the silver halide grains has been completed, the silver halide emulsion of the present invention may be given a pAg or ion concentration adapted to chemical sensitization by a suitable method such as the aggregation method, noodle washing, or the method described in Research Disclosure No. 17643.

The silver halide emulsion used in the X-ray silver halide photographic material according to the present invention may contain a stabilizer and an anti-foggant as described in U.S. Pat. Nos. 2,444,607, 2,716,062, 3,512,982, 3,342,596, German Pat. Nos. 1,189,380, 205,862, 211,841, Japanese Patent Publications Nos. 4183/68, 2825/64, and Japanese Patent Applications (OPI) Nos. 22626/75 and 25218/75. Particularly preferred compounds include 5,6-trimethylene-7-hydroxy-S-triazolo(1,5-a)pyrimidine, 5,6-tetramethylene-7-hydroxy-S-triazolo(1,5-a)pyrimidine, 5-methyl-7-hydroxy-S-triazolo(1,5-a)pyrimidine, 7-hydroxy-S-triazolo(1,5-a)-pyrimidine; gallic acid esters such isoamyl gallate, dodecyl gallate, propyl gallate and sodium gallate; mercaptans such as 1-phenyl-5-mercaptotetrazole and 2-mercaptobenzothiazole; benzotriazoles such as 5-bromobenzotriazole and 4-methylbenzotriazole; and benzoimidazoles such as 6-nitrobenzoimidazole.

The silver halide emulsion of the present invention may be spectrally sensitized with a suitable dye such as cyanine dye or merocyanine dye. These dyes may be used either alone or in combination in the regular spectral region, as described in Japanese Patent Applications (OPI) Nos. 2756/80 and 14743/80, and also in the ortho spectral region, as described in Japanese Patent Applications (OPI) Nos. 56425/73, 31228/76 and Japanese Patent Publication No. 25379/72. In a longer wavelength region, spectral sensitization can be made with a cyanine dye having a long methane chain, as described in Japanese Patent Application (OPI) No. 126140/76. Supersensitization can also be performed in a desired manner by using a suitable combination of dyes.

The coating solution of the X-ray silver halide photographic material according to the present invention may contain conventional photographic additives: a hardener such as aldehyde or aziridine hardener (e.g. those described in PB Report 19,921, U.S. Pat. Nos. 2,950,197, 2,964,404, 2,983,611, 3,271,175, Japanese Patent Publication No. 40898/71 and Japanese Patent Application (OPI) No. 91315/75); isoxazole hardener (e.g. the one described in U.S. Pat. No. 3,316,09), epoxy hardener (e.g. those described in U.S. Pat. No. 3,047,394, West German Pat. No. 1,085,663, British Pat. No. 1,033,518 and Japanese Patent Publication No. 35495/73), vinyl sulfone hardener (e.g. those described in PB Report 19,920, West German Pat. No. 1,100,942, British Pat. No. 1,251,091, Japanese Patent Applications Nos. 54236/70, 110996/73, U.S. Pat. Nos. 353,964 and 3,490,911), acryloyl hardener (e.g. those described in Japanese Patent Application No. 27949/73 and U.S. Pat. No. 3,640,720), carbodiimide hardener (e.g. those described in U.S. Pat. No. 2,938,892, Japanese Patent Publication No. 38715/71 and Japanese Patent Application No. 15095/74), as well as maleimide, acetylene, methanesulfonate ester, triazine and polymeric hardeners; a thickener of the type described in U.S. Pat. No. 3,167,410 and Belgian Pat. No. 558,143; a gelatin plasticizer such as polyol (e.g. those described in U.S. Pat. No. 2,960,404, Japanese Patent Publication No. 4939/68 and Japanese Patent Application (OPI) No. 63715/73) and latex (e.g. those described in U.S. Pat. No. 766,979, French Pat. No. 1,395,544 and Japanese Patent Publication No. 43125/73; and a matting agent of the type described in British Pat. No. 1,221,980.

The X-ray silver halide photographic material of the present invention may contain a desired coating aid in one or more of the constituent layers. For example, it may contain saponin or a sulfosuccinate ester surfactant, as described in British Pat. No. 548,532 and Japanese Patent Application No. 89630/72, or an anionic surfactant, as described in Japanese Patent Publication No. 18166/68, U.S. Pat. No. 3,514,293, French Pat. No. 2,025,688 and Japanese Patent Publication No. 10247/68.

For reducing the "cross-over", the X-ray silver halide photographic material according to the present invention may contain a dye in the layer under the emulsion layer of the present invention and contiguous to the base. Furthermore, the protective layer and/or the emulsion layer of the present invention may contain a dye for providing a sharper image or reducing the fog due to safelight. Any of the known dyes that are used to achieve these purposes can be used.

The emulsion of the present invention can be incorporated in a color photographic material by a conventional method using a conventional coupler. In one typical case, the emulsion is rendered red-, green- and blue-sensitive, and the combination of cyan, magenta and yellow couplers are incorporated in such emulsion. Useful couplers include an open-chain methylene yellow coupler, pyrazolone magenta coupler, phenol or naphthol cyan coupler. These couplers may be combined with an auto-masking coupler or compound such as a colored coupler (a coupler in which a split-off group having an azo group is attached on the active point), an osazone type compound, a development diffusible dye releasing coupler, or a development inhibitor releasing compound (the compound that reacts with an oxidized aromatic primary amine developing agent to release the development inhibiting compound, and included within the definition of this compound are a "DIR coupler" that reacts with an oxidized aromatic primary amine developing agent to form a colored dye and a "DIR substance" that reacts with the same oxidized developing agent to form a colorless compound). These couplers can be incorporated in the X-ray silver halide photographic material by any of the known methods conventionally used in the coupler technology.

The X-ray silver halide photographic material according to the present invention can be developed by any known method. If the material is a black-and-white photographic material, a common developing solution may be used that is made of one or more compounds selected from among hydroquinone, 1-phenyl-3-pyrazolidone, N-methyl-p-aminophenol and p-phenylenediamine. The developing solution may contain any conventional additive. If the X-ray silver halide photographic material of the present invention is for color photography, it may also be processed by a conventional technique of color development. The X-ray silver halide photographic material of the present invention can also be processed with a developing solution containing an aldehyde hardener, for instance, a developing solution that contains a dialdehyde (i.e. maleic dialdehyde or glutaraldehyde) or sodium bisulfite salt thereof, and this type of developing solution is known in the photographic art.

The present invention is now described in greater detail by reference to the following examples to which the possible embodiments of the present invention are by no means limited.

EXAMPLE 1

Preparation of Emulsion I

A polydispersed silver iodobromide emulsion containing 2 mol% silver iodide and made of platy grains of an average size of 1.02 μm was prepared as below. Aqueous solutions of ammoniacal silver nitrate and aqueous alkali halide solution were simultaneously fed by gravity in to a reactor that had been fed with an aqueous gelatin solution and excess halide, and the mixture was heated at 60° C. for 20 minutes. The standard deviation of the average grain size of the emulsion was 0.336 μm, and the value of $S/\bar{r}$ was 0.28. The reaction mixture was desalted with benzenesulfonyl chloride, and further mixed with gelatin to form an emulsion having a pAg of 7.8 and pH of 6.0. To the so prepared emulsion, sodium thiosulfate, ammonium chloroaurate and ammonium thiocyanate were added, the mixture was ripened chemically at 52° C. for 70 minutes, and further mixed with 4-hydroxy-6-methyl-1,3,3a,7-tetrazaindene, 6-nitrobenzoimidazole and gelatin to provide Emulsion I.

Preparation of Emulsion II

A monodispersed silver iodobromide containing 2 mol% silver iodide and having an average grain size of 1.15 μm was prepared as below. To a reactor that had been fed with potassium iodide and aqueous gelatin and which was held at a pAg of 8.6, aqueous solutions of ammoniacal silver nitrate and potassium bromide were added at a rate proportional to the increasing surface area of the growing silver halide grains. The standard deviation of the average grain size of the resulting emulsion was 0.104 μm, and the value of $S/\bar{r}$ was 0.09. The emulsion was subsequently ripened chemically as in the case of Emulsion I, and Emulsion II was obtained.

Preparation of Emulsion III

A monodispersed silver iodobromide emulsion containing 2 mol% silver iodide and having an average grain size of 0.62 μm was prepared as in the case of Emulsion II. The emulsion had a $S/\bar{r}$ value of 0.07. It was subsequently ripened chemically as in the case of Emulsion I, and Emulsion III was obtained.

A conventional coating aid and hardener were added to Emulsion I, and the mixture was applied onto both sides of a polyethylene terephthalate base, and the emulsion layer was overcoated with a gelatin protective layer. The silver halide emulsion layer was formed with a silver coating weight of 4.2 g per $m^2$, and with a gelatin content of 3.36 g per $m^2$. The so prepared photographic material was referred to as Sample No. I (control).

Emulsion II was likewise applied to a polyethylene terephthalate film so that the silver deposit was 5.5 per $m^2$. The so prepared photographic material was referred to as Sample No. II (control). The weight ratio of the silver halide to gelatin at the end of the application of the emulsion coating was the same as in Sample No. I.

A mixture of Emulsions II and III in a weight ratio of 7:3 was likewise applied to a polyethylene terephthalate base, and Sample No. III of the present invention having the same silver halide and gelatin coatings per $m^2$ as in Sample I was produced. Mixtures of Emulsions II and III in a weight ratio of 8.8:1.2 were likewise applied to a polyethylene terephthalate base, and Sample Nos. IV and V wherein the weight of the silver halide coating was 5.5 g and 4.2 g per $m^2$, respectively, in terms of silver were produced. The weight ratio of the silver halide to gelatin to the end of the application of the emulsion coating was the same as in Sample No. I.

The samples were exposed to an X-ray tube at 90 kVp, 50 mA for 0.08 second at 2 meters through an aluminum step wedge using a regular sensitizing screen ("Kyokko LT-II"). After exposure, the samples were processed in an automatic developing machine (QX-1200 of Konishiroku Photo Industry Co., Ltd.) at 35° C. with an XD-90 developing solution for a total processing time of 90 seconds. The density of the samples that was necessary for determining their X-ray sensitivity was measured with a densitometer, PDM-35 of Konishiroku Photo Industry Co., Ltd. The reciprocal of the exposure to X-ray at a degree of blackening (0.5 above fog) on the characteristic curve was calculated, and that value as relative to the value of Sample No. I which was assumed to be 100 was used as the sensitivity of the respective samples. The granularity of the samples was checked visually at a degree of blackening of 0.3 to 0.6, and rated as Δ (acceptable for ordinary purposes) or O (more satisfactory). The covering power (Cp) of the samples in the maximum density area was determined. The gelatin in each sample was decomposed with pancreatin and centrifuged to recover the silver halide grains. An electron micrograph of the grains was taken, and their number was counted. The results are shown in Table 1 below. The relation between the logarithm of the covering power and that of the sensitivity achieved is shown in FIG. 1. According to the study of G. C. Farnell [The Journal of Photographic Science, 17, 116(1969)], a series of emulsions having the same properties move on a set of straight lines having a certain gradient (−1 in FIG. 1) that represent a certain relation between the sensitivity and covering power. The same series of emulsions having average grain sizes of 0.88 μm, 0.94 μm and 1.10 μm were prepared as in the case of Emulsion I except that the rate of addition of aqueous solutions of ammoniacal silver nitrate and alkali halide was varied. FIG. 1 shows the relation between the covering power and sensitivity of the respective emulsions with a silver deposit of 4.2 g/$m^2$. In FIG. 1, the straight lines representing Sample Nos. III, IV and V are above those representing Sample Nos. I and II, and this shows that Sample Nos. III, IV and V of the present invention have higher sensitivity for a given covering power or that they have a greater covering power for a given sensitivity. At the same time, as Table 1 shows, the samples of the present invention use less silver and yet have improved granularity and high-sensitivity characteristics.

EXAMPLE 2

Preparation of Emulsion IV

A monodispersed silver iodobromide emulsion containing 2 mol% and having an average grain size of 1.28 μm was prepared as in the case of Emulsion II or III. The emulsion had an $S/\bar{r}$ value of 0.11. Like Emulsion I, II or III, this emulsion was subjected to chemical sensitization optimum for the silver halide grains to produce Emulsion IV.

Preparation of Emulsion V

Emulsions II, III and IV were mixed in a weight ratio of 6:2:2 before they were chemically sensitized, and like Emulsion I, II, III or IV, the mixture was subjected to chemical sensitization optimum for the silver halide grains to produce Emulsion V. Emulsions II and III (chemically sensitized) of Example 1 were mixed with Emulsion IV (also chemically sensitized) in a weight ratio of 6:2:2, and as in Example 1, gelatin and other additives were incorporated in the mixture, which was then applied to both sides of a polyethylene terephthalate base to produce Sample No. VI. Sample No. VII was prepared in the same manner using Emulsion V. Sample No. VIII was prepared using a mixture of Emulsion II (chemically sensitized) with Emulsion IV (also chemically sensitized) in a weight ratio of 1:1. All samples had a silver deposit of 4.2 g/$m^2$.

The same experiment was conducted as in Example 1, using Sample Nos. I and II as controls. The results are shown in FIG. 1

TABLE I

| Sample No. | Emulsion | Number of grains detected in the mixed emulsion | Fog | Sensitivity | Max. density | Silver deposit ($g/m^2$) | CP ($m^2/g \times 100$) | granularity |
|---|---|---|---|---|---|---|---|---|
| I | Emulsion I | — | 0.6 | 100 | 2.8 | 5.2 | 51 | Δ |
| II | " | — | 0.5 | 97 | 2.3 | 4.2 | 51 | Δ |
| III | Emulsion II | 123 | 0.5 | 105 | 2.8 | 4.2 | 63 | |
| | Emulsion III | 336 | | | | | | |
| IV | Emulsion II | 220 | 0.5 | 118 | 2.8 | 5.5 | 48 | |
| | Emulsion III | 190 | | | | | | |
| V | Emulsion II | 223 | 0.6 | 115 | 2.1 | 4.2 | 47 | |
| | Emulsion III | 195 | | | | | | |

and Table II below. One can see that the emulsions in Sample No. VI had the best sensitometric characteristics with the least silver content.

EXAMPLE 3

The eight samples prepared in Examples 1 and 2 were given a wedge exposure on both sides simultaneously in a sensitometer (Model KS-1 of Konishiroku Photo Industry Co., Ltd.) with a tungsten lamp, and were processed in an automatic developer as in Examples 1 and 2. The reciprocal of the exposure providing the density of 0.5 above fog was used as the sensitivity, and the relative light sensitivity with respect to that of Sample No.1 (100) was determined, and the ratio of the X-ray sensitivity determined in Examples 1 and 2 to the relative light sensitivity was calculated. The results are shown in Table III. One can see that the samples of the present invention had higher ratios of X-ray sensitivity to light sensitivity.

TABLE III

| Sample No. | I | II | III | IV |
|---|---|---|---|---|
| X-ray sensitivity / light sensitivity | 1.00 | 1.01 | 1.07 | 1.03 |
| Sample No. | V | VI | VII | VIII |
| X-ray sensitivity / light sensitivity | 1.04 | 1.06 | 1.02 | 1.01 |

EXAMPLE 4

The eight samples prepared in Examples 1 and 2 were exposed to X-rays as in Example 1, and processed at 35° C. in an automatic developer (OX-1200 of Konishiroku Photo Industry Co., Ltd.) for 30 seconds. The exposed samples were also tank-developed with a developing solution (the formulation indicated below) at 25° C. for 3.5 minutes, and subsequently fixed and washed in the conventional manner.

TABLE II

| Sample No. | Emulsion | Number of grains detected in the mixed emulsion | Fog | Sensitivity | Max. density | Silver deposit ($g/m^2$) | CP ($m^2/g \times 100$) | granularity |
|---|---|---|---|---|---|---|---|---|
| I | Emulsion I | — | 0.5 | 100 | 2.8 | 5.2 | 51 | Δ |
| II | " | — | 0.5 | 97 | 2.3 | 4.2 | 51 | Δ |
| VI | Emulsion II | 125 | 0.5 | 103 | 2.8 | 4.2 | 62 | |
| | Emulsion III | 268 | | | | | | |
| | Emulsion IV | 32 | | | | | | |
| VII | Emulsion V | — | 0.6 | 95 | 2.8 | 4.2 | 62 | |
| VIII | Emulsion II | 253 | 0.5 | 102 | 2.3 | 4.2 | 52 | |
| | Emulsion IV | 220 | | | | | | |

| Formulation of developer | |
|---|---|
| N—methyl-p-aminophenol sulfate | 3.0 g |
| Anhydrous sodium sulfite | 50.0 g |
| Hydroquinone | 6.0 g |

-continued

| Formulation of developer | |
|---|---|
| Sodium carbonate | 29.5 g |
| Potassium bromide | 1.0 g |
| Water to make | 1 liter |

The ratio of the sensitivity achieved by the automatic processing to that achieved by tank development was determined. The results are shown in Table IV below.

TABLE IV

| Sample No. | I | II | III | IV |
|---|---|---|---|---|
| automatic processing / tank development | 1.00 | 1.02 | 1.25 | 1.12 |
| Sample No. | V | VI | VII | VIII |
| automatic processing / tank development | 1.11 | 1.20 | 1.07 | 1.01 |

What is claimed is:

1. An X-ray silver halide photographic material comprising a base having formed thereon a silver halide emulsion layer substantially made of two or more monodispersed emulsions having silver halide grains with different average grain sizes in the range of about 0.2 to 3.0 μm, wherein the grain size distribution curve of the grains has two or more peaks, the distance between the highest peak and the second highest peak being at least 0.3 μm and wherein the number of the silver halide grains having a smaller grain size than the median of the grain size of all the grains incorporated in the monidispersed emulsions is larger than that of the silver halide grains having a grain size greater than the median.

2. A silver halide photographic material according to claim 1 wherein the number of the monodispersed emulsions does not exceed five.

3. A silver halide photographic material according to claim 1 wherein said silver halide is selected from a group consisting of AgBr, AgBrI, AgBrCl and AgBrClI.

4. A silver halide photographic material according to claim 1 wherein said silver halide grains in the emulsion of the largest peak essentially consists of regular octahedron crystals.

* * * * *